US005956068A

United States Patent [19]

Odai et al.

[11] Patent Number: 5,956,068

[45] Date of Patent: Sep. 21, 1999

[54] REVERSIBLE THERMAL PRINTER FOR PRINTING IN BOTH DIRECTIONS ON A PAGE

[75] Inventors: Yoshiaki Odai; Masaru Ohnishi, both of Kamakura, Japan

[73] Assignee: Mitsubishi Denki Kabushiki Kaisha, Tokyo, Japan

[21] Appl. No.: 08/792,766

[22] Filed: Feb. 4, 1997

Related U.S. Application Data

[63] Continuation of application No. 08/153,741, Nov. 17, 1993, abandoned.

[30] Foreign Application Priority Data

Feb. 25, 1993 [JP] Japan ..... 5-036829

[51] Int. Cl.[6] ..... B41J 13/036

[52] U.S. Cl. ..... 347/218; 400/636.2; 400/634

[58] Field of Search ..... 347/172, 174, 347/215, 176, 218; 400/617, 634, 636, 636.1, 636.2, 120.02, 120.04

[56] References Cited

U.S. PATENT DOCUMENTS 4,878,772 11/1989 Fukumoto et al. .
4,899,171 2/1990 Ogura et al. .
4,962,387 10/1990 Yamamoto et al. .

FOREIGN PATENT DOCUMENTS 59-220387 12/1984 Japan .
62144976 6/1987 Japan .
1-42263 2/1989 Japan .
2063774 3/1990 Japan .
4-10962 1/1992 Japan .

*Primary Examiner*—Huan Tran

[57] ABSTRACT

A forward/backward printing thermal printer which brings a printing paper onto a printing member and performs a printing action in order to form an image. The printer comprises a thermal head which transfers the image onto the paper according to an image signal, a platen roller which moves the paper back and forth when it rotates, and a pair of which press the paper on the platen roller and cause it to move back and forth with the roller. When the paper moves and is no longer held on one side by a, the paper pressing means on the side where the paper has been released is moved on the outer circumference of the platen roller by a fan-shaped gear rotated by a drive gear so as to again grip the edge of the paper which is carried to the position of the other. In this way, the effective printing range on the paper is enlarged without any error in the paper's position or color due to the transport mechanism. The printer can also be made compact.

16 Claims, 8 Drawing Sheets

REVERSIBLE THERMAL PRINTER FOR PRINTING IN BOTH DIRECTIONS ON A PAGE

This application is a continuation of application Ser. No. 08/153,741, filed Nov. 17, 1993, now abandoned.

BACKGROUND OF THE INVENTION

1. Field of the Invention

This invention relates to a thermal printer, and in particular to a forward/backward printing thermal printer (referred to hereafter simply as a thermal printer) which moves a paper sheet forward and backward along a platen roller and prints on the paper several times so as to form an color image.

2. Description of the Prior Art

In a conventional thermal printer, a paper guided to a printing member while being gripped between a platen roller and pinch roller, and an ink sheet of a predetermined color guided to a thermal head by a different path to that of the paper, are superposed. Ink on the ink sheet is then transferred to the paper by the thermal head which is heated according to input image data. After printing with a first color ink sheet is complete, the colored ink sheet is discharged, and the paper alone is moved back to the position at which printing was begun. A second color ink sheet is then supplied, and image transfer performed using this second color ink sheet. The same paper is moved back and forth and the ink sheet is changed so that by superposing predetermined colors according to image data (usually, yellow, magenta, cyan and if necessary black), a color image composed of desired colors is formed.

FIG. 1 is a schematic view of, for example, the printing parts of a conventional thermal printer as is disclosed in, for example, Japanese Tokkai Sho 64-42263. This color thermal printer comprises a thermal head 12 which heats, according to input image data, ink on an ink sheet 10 consisting of a PET film or the like coated on one side with a thermofusible ink so that the ink melts and is transferred to a paper 11, a platen roller 13 which moves the paper 11 and ink sheet 10 on a printing member of the thermal head 12, a supply side pinch roller 14 which transports the paper 11 while pressing it on the platen roller 13, and a discharge side pinch roller 15. The paper 11 is firmly gripped between the platen roller 13 and the pinch rollers 14, 15 so that even if the paper 11 is moved forwards and backwards in order to perform printing by superposition, positional errors due to paper transport are avoided and color errors are prevented.

The action of a color thermal printer having this construction will now be described with reference to FIG. 2. As shown in FIG. 2A, the supply paper 11 is guided between the platen roller 13 and the supply side pinch roller 14 to the thermal head 12 or to a previously supplied ink sheet 10, and then passes between the platen roller 13 and discharge side pinch roller 15. An action referred to as blank feed is then performed. In this action, after the paper has been sent to the position shown in FIG. 2B, it returns to the position shown in FIG. 2A without any printing being performed. At this time, the pinch roller which is behind the paper with respect to its forward direction of movement, rotates at a slower speed than the platen roller. In other words, the pinch roller 14 on the paper supply side rotates at a slower speed than the platen roller until the paper reaches the position shown in FIG. 2B, and the pinch roller 15 on the paper discharge side rotates at a slower speed than the platen roller 13 until the paper returns shown in FIG. 2A. A back tension therefore acts upon the paper 11 when the paper is transported forwards and backwards due to the pinch roller 14 or 15, drawing the paper out so that it is in close contact with the platen roller 13.

After the action of blank feed, while the paper 11 is moving from the position shown in FIG. 2A to the position shown in FIG. 2B, the thermal head 12 which is in pressure contact with the platen roller 13 via the paper 11 prints in yellow according to yellow image data by using a yellow ink sheet 10 which supplies yellow ink.

Next, after releasing pressure contact of the thermal head 12 and the platen roller 13, the paper 11 is returned to the position of FIG. 2A, the ink sheets 10 simultaneously changes to the next color (magenta), the thermal head 12 again comes into pressure contact with the platen roller 13 and printing is performed in magenta. Subsequently, the same paper 11 is printed in the same way by ink sheet of desired colors, and a color image consisting of desired colors is formed on the paper 11.

However, in the heat transfer color thermal printer having the aforesaid construction, positional errors when the paper 11 is moved forwards and backwards must be prevented, and it is therefore necessary to ensure that the paper is constantly supported on the platen roller 13 by the pinch rollers 14, 15. In other words, when the paper 11 was sent for printing, paper feed had to be stopped at a position where the rear edge of the paper 11 could be gripped between the platen roller 13 and the pinch roller 14 as shown in FIG. 2B, and when the paper 11 was returned to be printed by the next color, paper return had to be stopped at a position where the front edge of the paper 11 could be gripped between the platen roller 13 and the pinch roller 15 as shown in FIG. 2A. If the paper 11 does not return properly when it is attempted to return it to its position between the pinch rollers and the platen roller after being released from these rollers, printing by superposition cannot be performed, the paper creases, and goes slack which leads to a color error. It was therefore impossible to release the edges of the paper from the rollers' grip. As a result, printing could not be performed on the parts of the paper extending from the contact points of the pinch roller and the platen roller to the thermal head, corresponding to a distance $L_1$ in the case of the front edge of the paper, and a distance $L_2$ in the case of the rear edge of the paper, and the length of paper over which printing could be performed was consequently reduced.

In order to solve the aforesaid problems, as shown in FIG. 3, a thermal printer wherein a paper 31 supported by a clamp 32 is printed with a predetermined color while the paper 31 is directly transported in the direction X in the figure via a predetermined path by a paper transport mechanism 33, and wherein printing can be performed up to the rear edge of the paper, is disclosed in for example Japanese Tokkai Hei 4-10962. In this thermal printer 30, the paper 31 is transported while being supported by a guide means 35 so that, even after the rear edge of the paper 31 has passed the contact point of a platen roller 34 and a pinch roller 37, paper transport continues and printing can be performed up to the very edge of the paper 31. After printing of the first color is completed, a thermal head 39 withdraws to the position shown in FIG. 3B, a drive gear 36*b* simultaneously rotates in the direction $R_1$ shown in the figure, and a fan-shaped gear 36*a* rotates in the direction $R_2$ shown in the figure. The pinch roller 37 which is fixed to the fan-shaped gear 36*a* moves to a position where it can grip the paper 31 which has been printed up to the very edge. Subsequently, the platen roller 34 and the guide means 35 rotate in opposite directions to their rotation directions during printing, the clamp 32 moves in the direction $X_2$ shown in the figure, inserts the paper firmly so that it is gripped between the platen roller 34 and the pinch roller 37, and the paper is then returned to the position where printing began.

After the backward movement of the paper 31 is complete, the drive gear 36*a* rotates in the opposite direction $R_1$ so as to return the pinch roller 37 to its initial position (position in FIG. 3A), and the thermal head 39 comes into pressure contact with the platen roller 34 in order to begin printing with the next color. While the paper is returning as described hereintofore, an ink sheet 38 is changed over. The paper 31 is then overprinted by a linear back and forth motion in the same way, and a color image composed of desired colors can therefore be printed on the paper 31 up to the very edge of the paper.

However, although according to this method the paper can be printed up to the very edge of one end of the sheet, the front edge of the paper could not be printed as it was supported by the clamp 32. Further, the length of the paper transport mechanism 33 required to move the paper 31 back and forth must be equal to or greater than the length of the paper 31, which tended to make the size of the heat transfer color printer too large.

SUMMARY OF THE INVENTION

It is therefore an object of this invention to provide a thermal printer which gives no color error during superposed printing, enables the printing range to be increased, and can be made compact.

In order to solve the aforesaid problems, firstly, this invention provides a forward/backward printing thermal printer which moves a printing paper back and forth on a printing member a plurality of times in order to form an image, said printer comprising:

(a) a platen roller which rotates so as to wind the paper onto part of its outer circumference, and moves the paper back and forth by rotating forward and backward, (b) a thermal head disposed facing the platen roller, the head heating the ink on an ink sheet according to an input image signal so as to transfer the image to the paper, (c) a thermal head moving mechanism which presses the thermal head onto or releases it from the platen roller, and (d) a pair of paper pressing means which press the paper onto the platen roller so that the paper moves forward and backward with the roller when the roller rotates, the arrangement being such that when the paper moves forward so that it is no longer pressed by the paper pressing means on one side, the paper pressing means on the side where the paper has been released moves over the outer circumference of the platen roller so as to grip the paper again and cause the forward/backward motion of the paper to recommence.

Secondly, this invention provides a forward/backward printing thermal printer as has Just been described, wherein the paper pressing means which is free to move is smaller than the paper pressing means on the other side.

Thirdly, this invention provides a forward/backward printing thermal printer similar to either of those previously described wherein the force with which the paper pressing means which is free to move presses the platen roller is less than the force with which the other paper pressing means presses the platen roller.

Fourthly, this invention provides a forward/backward printing thermal printer similar to any at those previously described, wherein the movement of the paper pressing means which is free to move on the platen roller is coupled with the pressure contact or release of pressure contact of the thermal head on the platen roller.

Fifthly, this invention provides a forward/backward printing thermal printer as initially described, wherein a paper pressing means which is free to move is situated on both the paper supply side and the paper discharge side.

Sixthly, this invention provides a forward/backward printing thermal printer wherein the printing action on the edge of the paper takes place when the printing of other parts of the paper has finished, and the paper is returned to the paper supply side.

Seventhly, this invention provides a forward/backward printing thermal printer which moves a printing paper forward and backward on a printing member a plurality of times in order to form an image, the printer comprising:

(a) a platen roller which rotates so as to wind the paper onto part of its outer circumference, and moves the paper back and forth by rotating forward and backward, (b) a thermal head disposed facing the platen roller, said head heating said printing member according to an input image signal, and heating the ink on an ink sheet so as to transfer the image to the paper, (c) a pair of paper pressing means which press the paper onto the platen roller so that the paper moves back and forth with the roller when the roller rotates, and (d) at least one paper guide member situated between the paper pressing means and the thermal head in a position facing the platen roller.

ADVANTAGES OF THE INVENTION

In the thermal printer according to this invention, when the rear edge of the paper has been transported to a paper pressing means on the paper discharge side, or when its front edge has been transported to a paper pressing means on the paper supply side, the other paper pressing means moves over the outer circumference of a platen roller so that the paper, which has been released from the grip of the platen roller and one paper pressing means, can again be firmly gripped. In this way, positional errors and color errors during printing can be eliminated, the rear edge of the paper can be transported to the paper pressing means on the paper discharge side, and the front edge of the paper can be transported to the paper pressing means on the paper supply side so that the printing range on the paper can be enlarged. Further, the paper is transported only by the platen roller and paper pressing means, so the paper transport mechanism can be made more compact.

If only one of the paper pressing means moves over the outer circumference of the platen roller, the moving paper pressing means is made smaller than the non-moving paper pressing means. The amount of motion of the thermal head with respect to the platen roller can then be reduced, and the thermal printer can be made more compact. Further, the pressure contact force on the platen roller of the moving paper pressing means is arranged to be less than that of the non-moving paper pressing means. There is therefore less resistance due to unevenness of the transport force and less resistance due to friction with the paper due to the fact that the moving paper pressing means has only a guiding function. Hence, positional errors of the paper are eliminated, and printing quality is improved.

Further, by providing a paper guide member between the thermal head and the paper pressing means, the printing range can be increased without providing a drive mechanism for the paper pressing means.

DESCRIPTION OF THE PREFERRED EMBODIMENT

Figure 1:
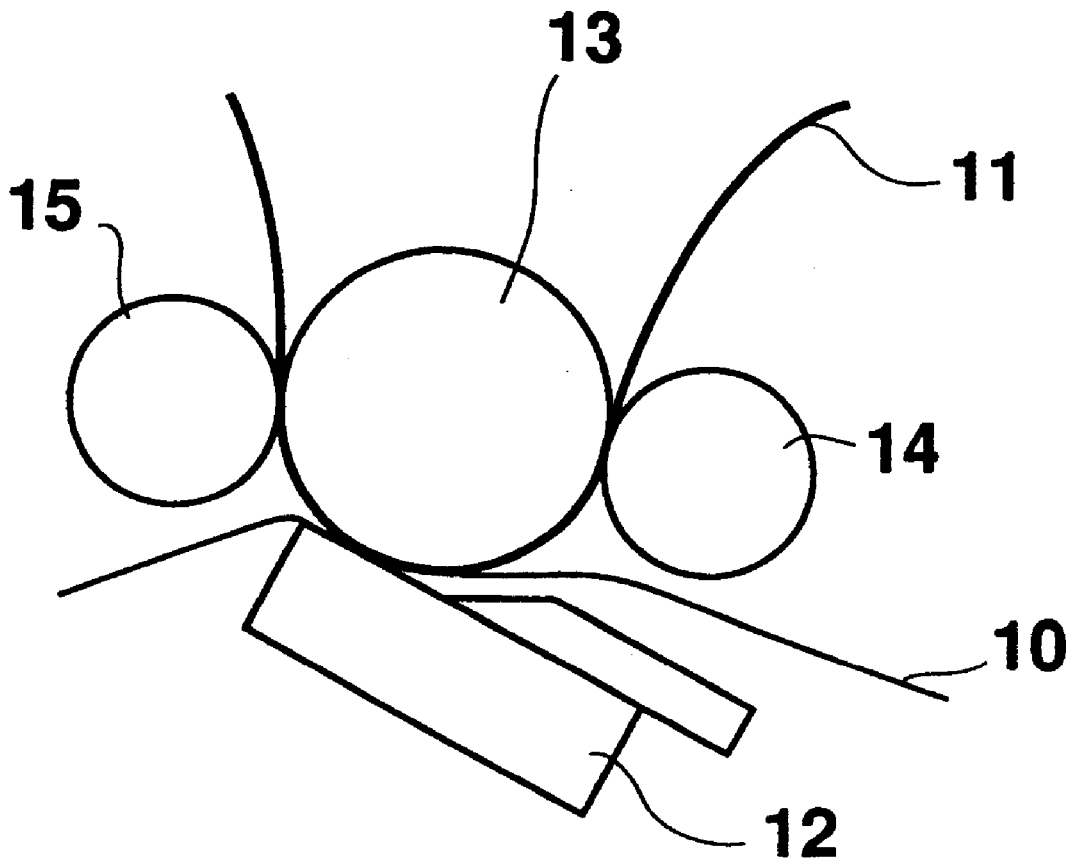
Fig. 1 PRIOR ART
FIG. 1 is a schematic drawing showing the main printing parts of a forward/backward printing thermal printer according to the prior art.
Figure 2A:
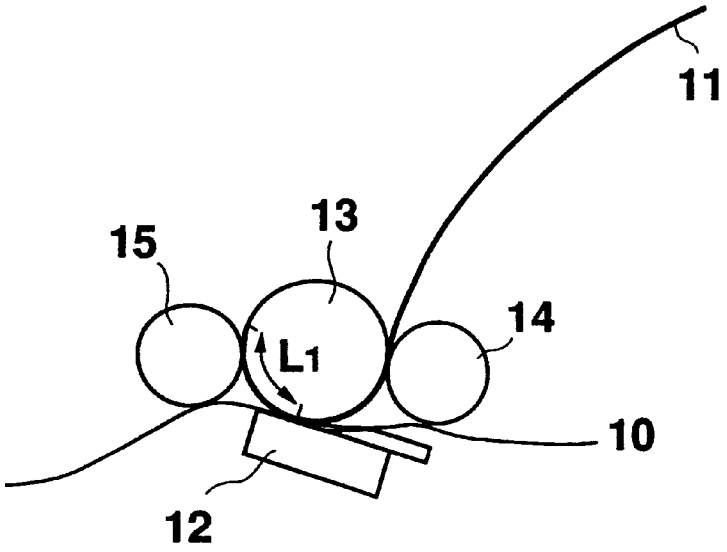
Fig. 2A PRIOR ART
FIG. 2A is a drawing showing the first part of the printing action of a forward/backward printing thermal printer according to the prior art.
Figure 2B:
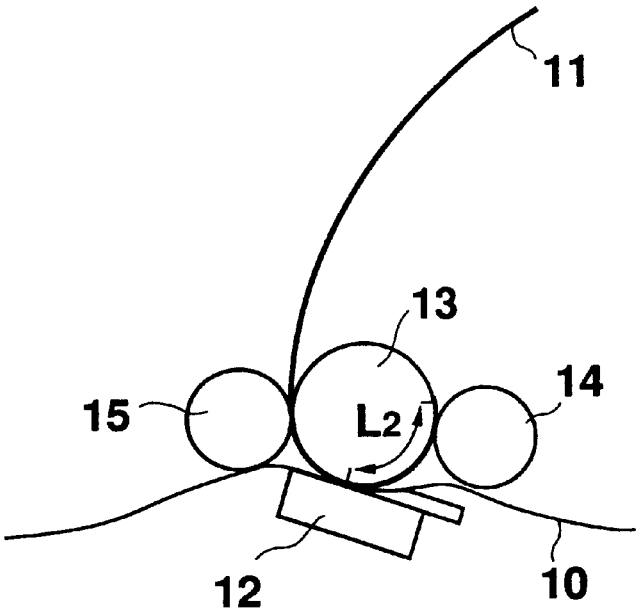
Fig. 2B PRIOR ART
FIG. 2B is a drawing showing the second part of the printing action of a forward/backward printing thermal printer according, to the prior art.
Figure 3A:
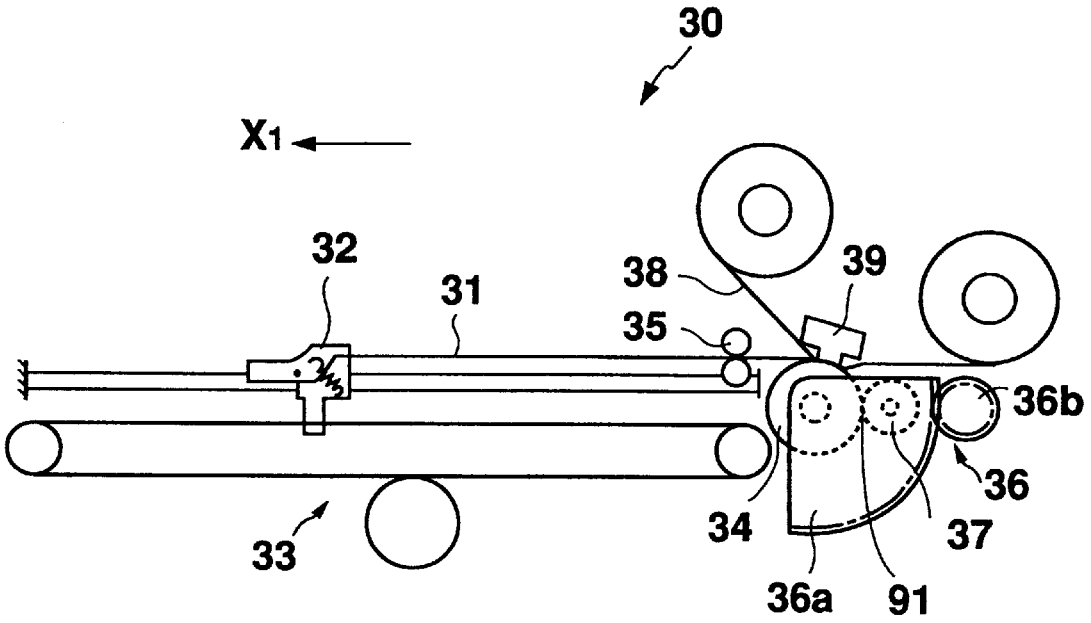
Fig. 3A PRIOR ART
FIG. 3A is a drawing showing the first part of the printing action of another forward/backward printing thermal printer according to the prior art.
Figure 3B:
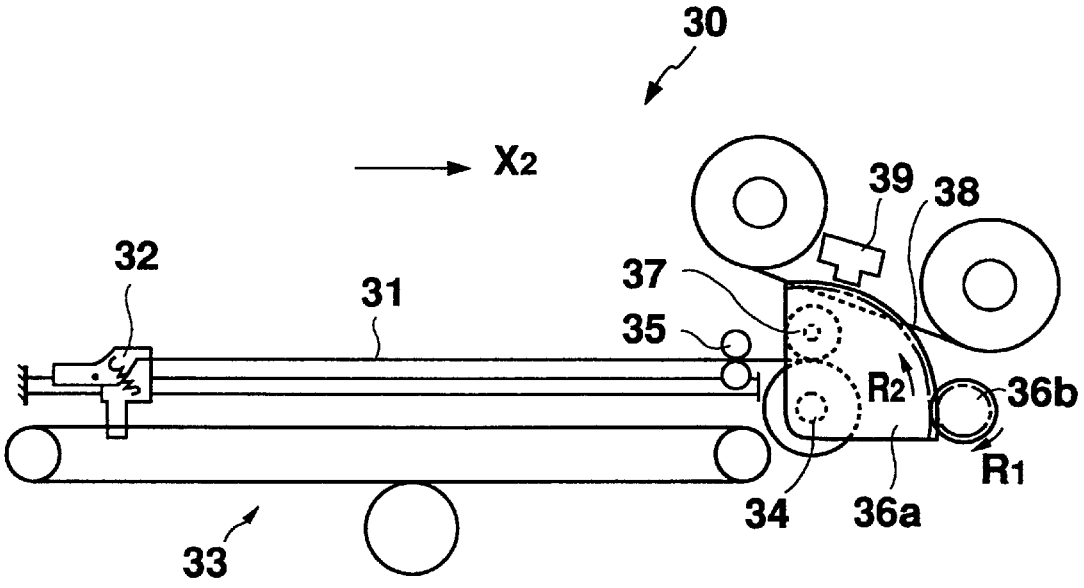
Fig. 3B PRIOR ART
FIG. 3B is a drawing showing the second part of the printing action of another forward/backward printing thermal printer according to the prior art.

The first embodiment of this invention will now be described with reference to the drawings.

The color thermal printer of this invention comprises a thermal head 42 which heats and melts ink on an ink sheet 40 consisting of thermofusible ink coated on one side of a PET film in accordance with input image data so as to transfer it to a paper 41, a thermal head shift mechanism 42*a* which presses the thermal head 42 onto or releases it from a platen roller 43 to be described hereinafter, a platen roller 43 which transports the paper 41 and the ink sheet 40 to the printing part of the thermal head 42, a paper feed pinch roller 44 which rotates as it presses the paper 41 onto the platen roller 43, and a paper discharge pinch roller 45. The same paper 41 is transported forward and backward over the printing part of the thermal head 42 by the rotation of the platen roller 43 and the pinch rollers 44, 45 so as to superimpose several images on the paper.

This invention is characterized in that it comprises a pinch roller shift means installed so as to be free to rotate about the rotation axis 43*a* of the platen roller 43, wherein the paper supply pinch roller 44 is caused to slide on the outer circumference of the platen roller 43 to a position near the paper discharge pinch roller 45 by a paper supply fan-shaped gear 47 driven by a drive gear 46 so that the paper 41, released from the grip of the platen roller 43 and the paper supply pinch roller 44, is gripped again.

The forward/backward transport of the paper 41 will now be described with reference to FIG. 4 which is a schematic view of the essential parts of the printer, and FIGS. 5*a–d,* FIGS. 6*a–d* which summarize its method of operation. In FIGS. 5*a–d* and FIGS. 6*a–d* the ink sheet 40, drive gear 46 and paper supply fan-shaped gear 47 are omitted so as to simplify understanding of the positional relationship of the thermal head 42, and the pinch rollers 44, 45.

Figure 4:
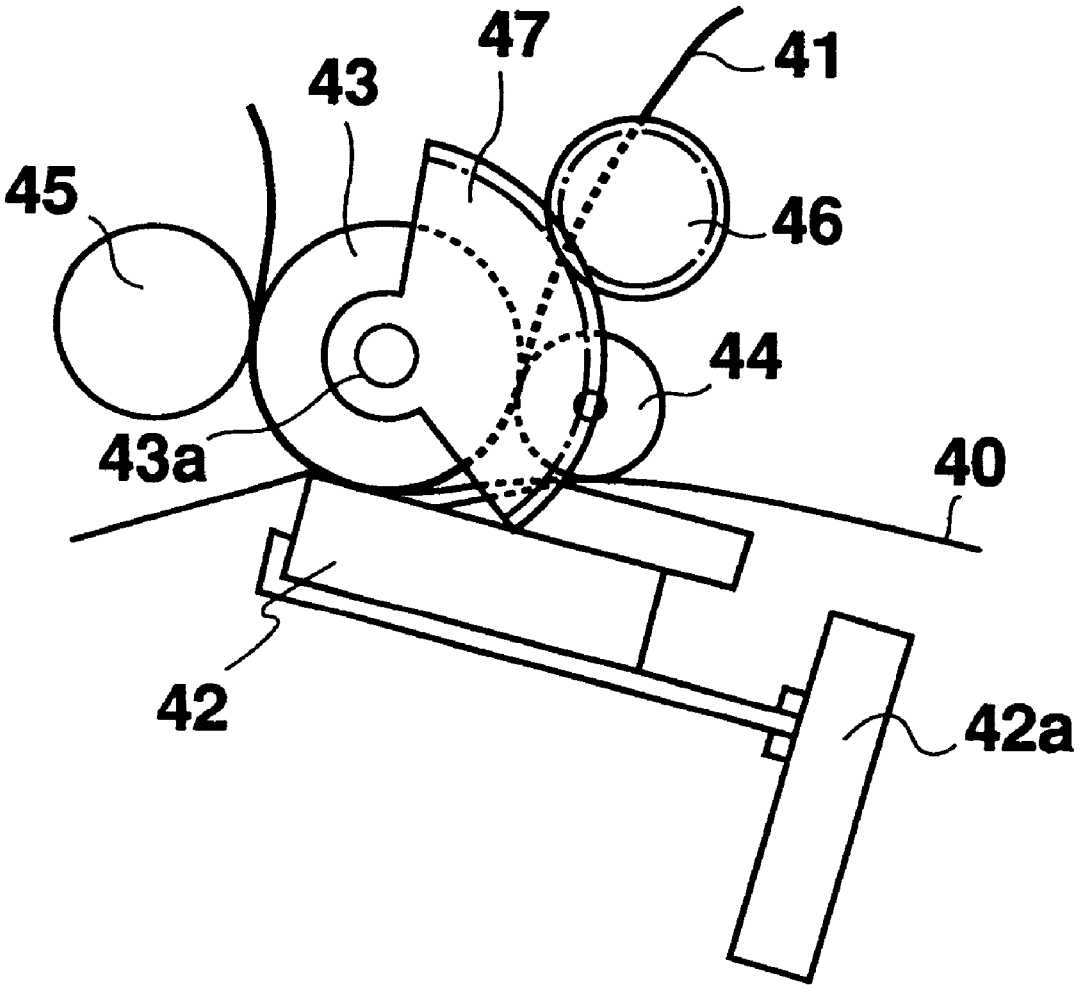
FIG. 4 is a schematic drawing showing the printing parts of one embodiment of the forward/backward printing thermal printer according to this invention.
Figure 5A:
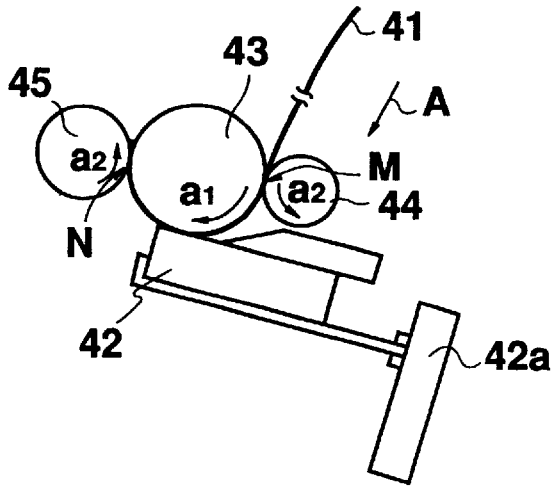
FIG. 5A is a drawing showing one embodiment of the forward/backward printing thermal printer according to this invention when printing begins.
Figure 5B:
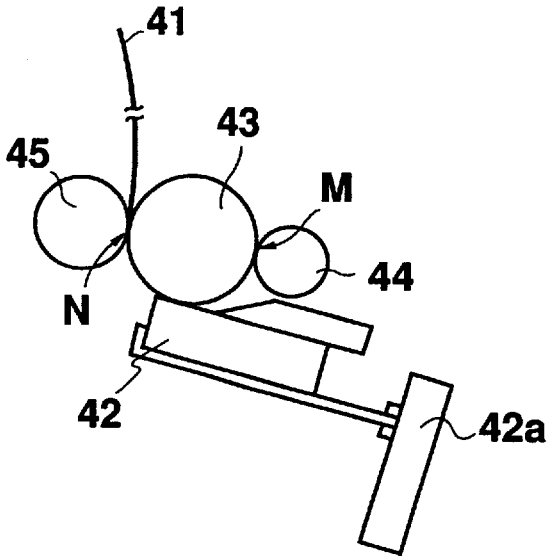
FIG. 5B is a drawing showing one embodiment of the forward/backward printing thermal printer according to this invention when a first color has been printed.
Figure 5C:
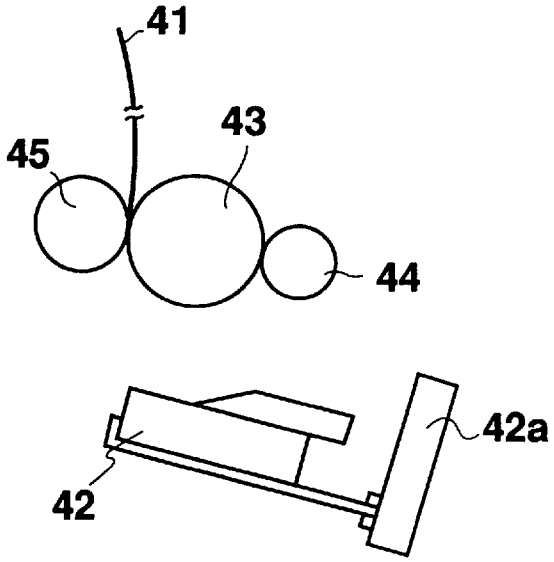
FIG. 5C is a drawing showing one embodiment of the forward/backward printing thermal printer according to this invention when the thermal head has retracted.
Figure 5D:
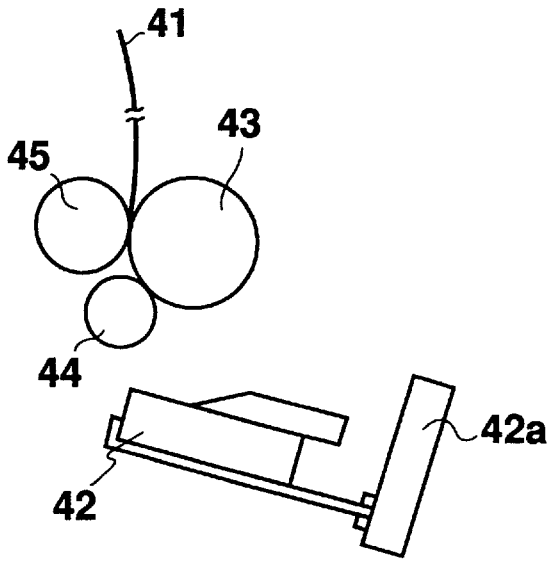
FIG. 5D is a drawing showing how the pinch roller on the paper supply side moves in one embodiment of the forward/backward printing thermal printer according to this invention.

In FIGS. 5*a–d,* the paper 41 is transported forward without printing in order to take up the slack in it, and is then brought into close contact with the outer circumference of the platen roller 43. The platen roller 43 and pinch rollers 44, 45 are then rotated in the directions of arrows $a_1$, $a_2$ so as to transport the paper in the direction A as shown in FIG. 5A, and printing begins with an ink sheet of a first color. During this printing, the transport of the paper 41 continues even after the paper has passed through a grip assembly M formed by the platen roller 43 and the paper supply pinch roller 44 so that printing is performed up to the rear edge of the paper 41. After printing is finished, transport of the paper 41 continues, and rotation of the platen roller 43 and paper discharge pinch roller 45 stops just before the rear edge of the paper 41 passes through a grip assembly N formed by the platen roller 43 and paper discharge pinch roller 45 as shown in FIG. 5B. Also after printing is completed, the thermal head 42 is immediately retracted from the platen roller 43 by the thermal head shift mechanism 42*a* as shown in FIG. 5C. This thermal head shift mechanism 42*a* may be driven by a rack and pinion, or by means of a belt, but a necessary condition is that the pressure and release action of the thermal head 42 on the platen roller 43 is performed smoothly. When the shift of the thermal head 42 is finished, the paper supply pinch roller 44 is shifted by a pinch roller shift means shown in FIG. 4. For this purpose, the drive gear 46 is rotated anticlockwise so that the paper-supply fan-shaped gear 47 engaged with the drive gear 46 rotates clockwise. This has the effect of moving the paper supply pinch roller 44, which is engaged with the paper supply fan-shaped gear 47, over the outer circumference of the platen roller 43 to a position near the paper discharge pinch roller 45 as shown in FIG. 5D.

Figure 6A:
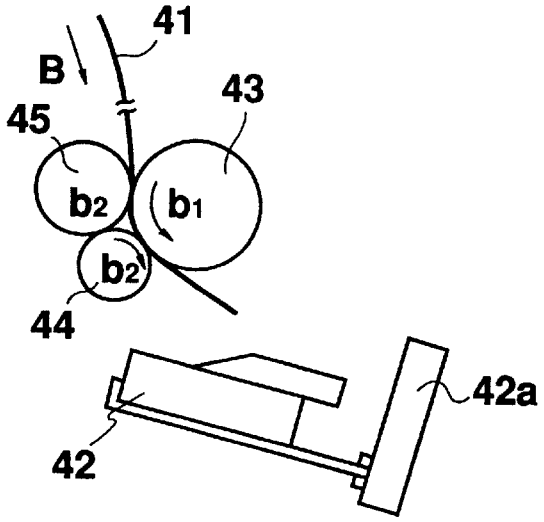
FIG. 6A is a drawing showing one embodiment of the forward/backward printing thermal printer according to this invention when backward transport of the paper has begun.
Figure 6B:
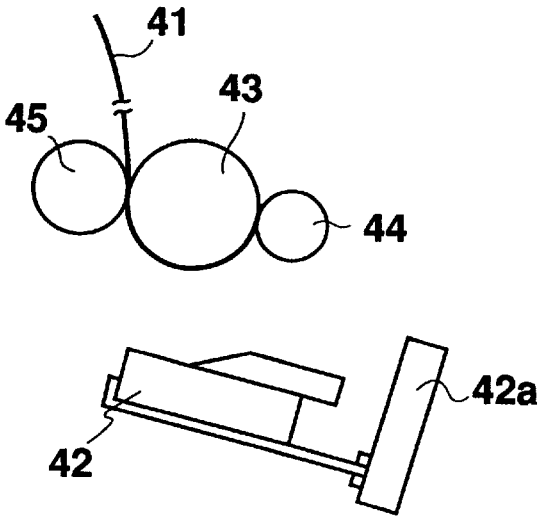
FIG. 6B is a drawing showing one embodiment of the forward/backward printing thermal printer according to this invention when the pinch roller on the paper supply side has returned
Figure 6C:
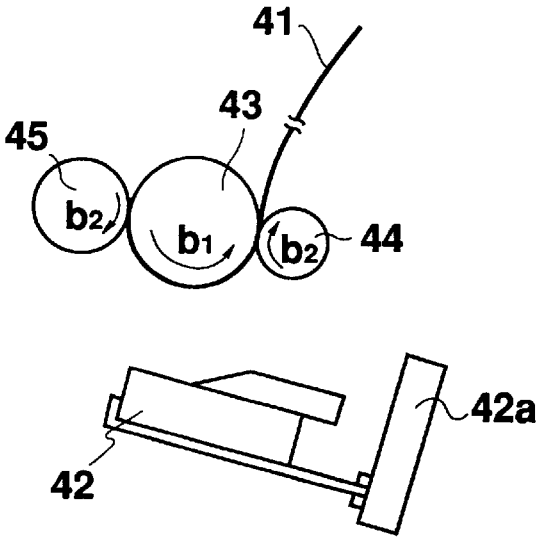
FIG. 6C is a drawing showing one embodiment of the forward/backward printing thermal printer according to this invention when backward transport of the paper has finished.
Figure 6D:
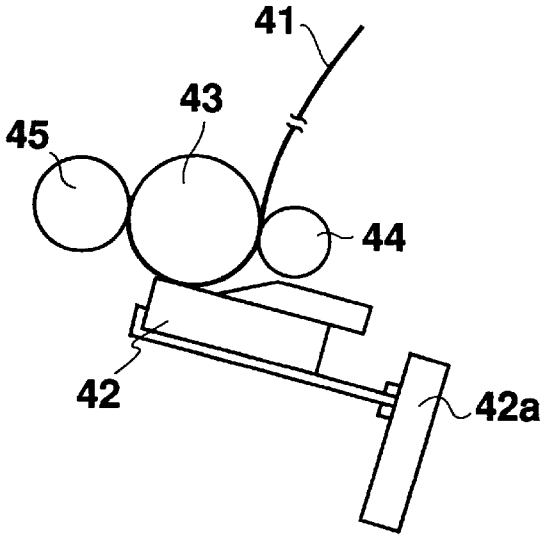
FIG. 6D is a drawing showing one embodiment of the forward/backward printing thermal printer according to this invention when printing of a second color begins.

Next, the platen roller 43 and pinch rollers 44, 45 rotate in the directions of arrows $b_1$, $b_2$ so as to transport the paper 41 by a predetermined amount in the direction B as shown in FIG. 6A, and then temporarily stop. The drive gear 46 is then rotated clockwise so that the paper supply fan-shaped gear 47 rotates anticlockwise. This has the effect of moving the paper supply pinch roller 44 over the circumference of the platen roller 43 back to its initial position as shown in FIG. 6B. It is desirable that the predetermined amount by which the paper 41 is transported which was mentioned in the discussion of FIG. 6A, is at least sufficient for the paper supply pinch roller 44 to be able to grip the rear edge of the paper 41 when the roller 44 has returned to its initial position. By performing the actions shown in FIG. 6A, 6B, the paper 41 which left the platen roller 43, is again brought into close contact with the platen roller 43. The platen roller 43 and pinch rollers 44, 45 are again rotated in the directions of the arrows $b_1$, $b_2$ so as to transport the paper 41 back to the position where printing begins, as shown in FIG. 6C. The thermal head 42 is then brought into pressure contact with the platen roller 43 by the thermal head shift mechanism 42*a*. While the thermal head 42 is separated from the platen roller 43, an ink sheet 40 of a second color is supplied as shown in FIG. 4, and is pressed onto the paper 41 when the thermal head 42 is brought into pressure contact with the platen roller 43. After these preparations for printing with the second color are complete, the paper 41 is printed with the second color according to second color printing data so as to superpose a second color over the first color.

The aforesaid operations are then repeated so as to print the paper 41 with a third color and fourth color, etc., so as to form an image having desired colors on the paper. Part of the paper 41 is always gripped by the paper discharge pinch roller 45 and platen roller 43, and when the paper 41 is transported back, the paper supply pinch roller 44 is moved near to the paper discharge pinch roller 45 so that the paper 41 is gripped firmly. This eliminates positional errors or slack due to forward and backward transport of the paper 41. As a result, there are no color position errors when colors are superposed, and the paper 41 can be printed right up to the rear edge. Further, as the paper 41 is transported only by the platen roller 43 and the pair of pinch rollers 44, 45, the paper transport mechanism, and hence the thermal printer, can be made more compact.

Figure 7:
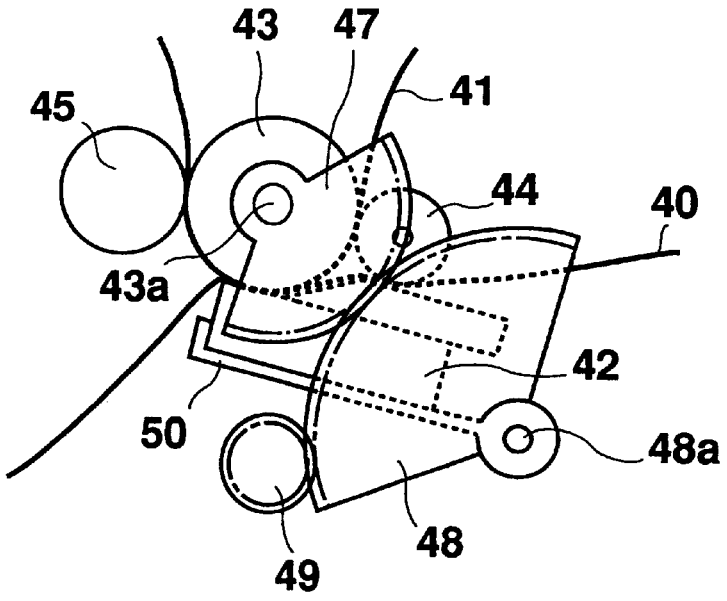
FIG. 7 is a schematic drawing showing the main parts of the printing member of a second embodiment of the forward/backward printing thermal printer according to this invention.

FIG. 7 shows the second embodiment of a thermal printer according to this invention.

In FIG. 7, the members 40–45 and 47 are the same as those of the first embodiment shown in FIG. 4, so their description will be omitted. In this second embodiment, a second fan-shaped gear 48 having a central rotation axis 48*a*, engages with the paper supply fan-shaped gear 47 which moves the paper supply pinch roller 44 over the outer circumference of the platen roller 43, and a drive gear 49 engages with this second fan-shaped gear 48. A thermal head support member 50 which supports the thermal head 42 is fixed on the second fan-shaped gear 48 so that it rotates in the same direction as the gear 48 when the gear 48 rotates.

A characteristic feature of the second embodiment is that the thermal head 42 moves in synchronism with the motion of the paper supply pinch roller 44. When the paper 41 is printed up to its rear edge and comes to the position shown in FIG. 5B, the drive gear 49 is rotated in a clockwise direction so that the second fan-shaped gear 48 rotates in an anticlockwise direction. This has the effect of moving the thermal head support member 50 which supports the thermal head 42, away from the platen roller 43. At the same time, the second fan-shaped gear 48 rotates the paper supply fan-shaped gear 47 which is engaged with it in a clockwise direction, so that the paper supply pinch roller 44 moves over the outer circumference of the platen roller 43 to a position near to the paper discharge pinch roller 45. The paper 41 is then transported back in the direction B as in the first embodiment shown in FIG. 6A, and the pinch rollers 44 and 45 are moved by the reverse procedure described hereintofore so as to prepare to print the paper with a second color.

As the paper supply pinch roller 44 and the thermal head 42 can be moved simultaneously, the operation time is shortened. Further, according to this embodiment, the motions of the paper supply pinch roller 44 and the thermal head 42 are mechanically coordinated, but independent drive means may also be provided and their motion coordinated by a control sequence.

Figure 8:
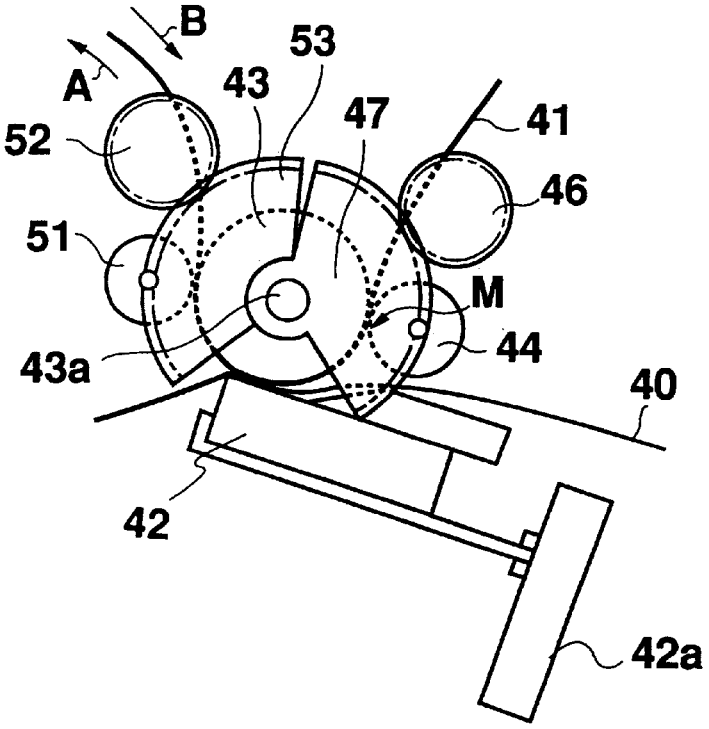
FIG. 8 is a schematic drawing showing the main parts of the printing member of a third embodiment of the forward/backward printing thermal printer according to this invention.

FIG. 8 shows the third embodiment of a thermal printer according to this invention.

In the aforesaid first and second embodiments, the case was described where only the paper supply pinch roller 44 moves over the outer circumference of the platen roller 43. As shown in FIG. 8, however, a paper discharge pinch roller 51 can also be moved over the outer circumference of the platen roller 43 by the same method as for the paper supply pinch roller 44. In other words, in the first and second embodiments, it was not possible to print the front edge of the paper 41. If necessary, however, by moving the position of the paper discharge pinch roller by the same method as that used for the paper supply roller 44, the printing range can be extended to the front edge of the paper 41. In other words, by moving the paper discharge roller 51 to a position near to the thermal head 42, the length of the front edge of the paper 41 necessary for gripping can be shortened. Further, in the aforesaid first and second embodiments, when printing with the first color has finished, the front edge of the paper 41 by which it is gripped can be printed alone when the paper is transported back in the direction B shown in the figure so that the whole of the paper 41 is finally printed. After printing of the paper 41 is finished, it is transported to a contact point M between the platen roller 43 and the paper supply pinch roller 44. According to the third embodiment, the paper discharge pinch roller 51 moves near to the paper supply pinch roller 44 so that it acts as a guide when the paper 41 is transported in the direction A shown in the figure. The paper 41 is thereby guided to the position where printing begins, and the paper can be prepared for printing with a second color without any positional errors.

Figure 9:
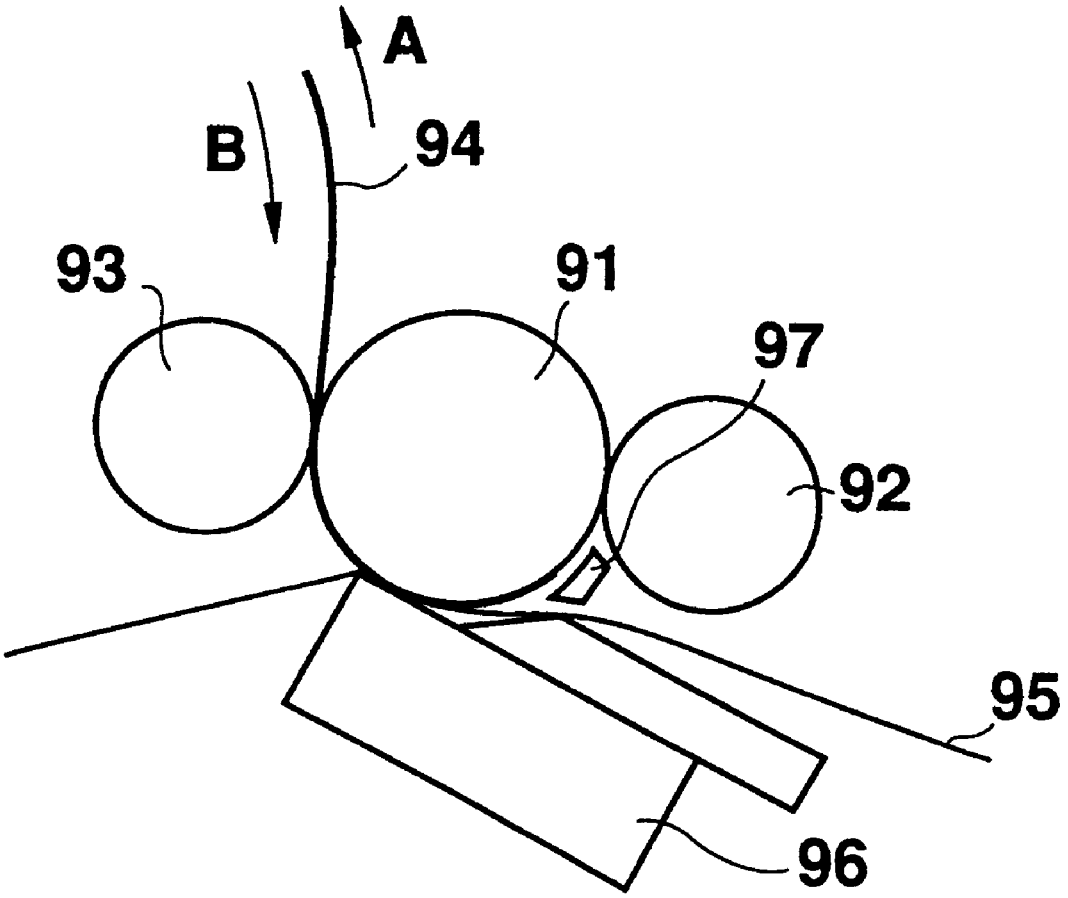
FIG. 9 is a schematic drawing showing the main parts of the printing member of a fourth embodiment of the forward/backward printing thermal printer according to this invention.

FIG. 9 shows the fourth embodiment of a thermal printer according to this invention.

According to the fourth embodiment, a paper supply pinch roller 92 and paper discharge pinch roller 93 on either side of a platen roller 91 are fixed at predetermined positions such that they are free to rotate.

A characteristic feature of the fourth embodiment is that a plastic paper guide 97 is disposed at a position approx. 1 mm from the platen roller 91 between the paper supply pinch roller 92 and a thermal head 96.

As shown in FIG. 9, this paper guide 97 guides a sheet of paper 94 so that it can be printed even after it is no longer gripped by the paper supply pinch roller 92 and platen roller 91. After printing is finished, the paper 94 is transported in the direction B shown in the figure by the platen roller 91 and paper discharge pinch roller 93. The paper 94 is easily fed between the platen roller 91 and the paper supply pinch roller 92 by the paper guide 97. The printing range of the paper 94 can therefore be extended without providing a pinch roller drive mechanism.

According to this embodiment, the paper guide 97 was disposed on the paper supply side. It may however also be disposed on the paper discharge side so as to guide the paper. In this case, printing can begin before the paper 94 is gripped by the platen roller 91 and paper discharge pinch roller 93, so the length of the front edge of the paper which can be printed is extended. Further, the paper guide may also be made of metal or rubber.

According to the first, second and third embodiments, if only one pinch roller can move over the outer circumference of the platen roller, and the outer diameter of the moving pinch roller is arranged to be smaller than the outer diameter of the fixed pinch roller, the amount of motion of the thermal head with respect to the platen roller can be reduced, and the thermal printer can be made more compact.

Further, according to the first, second and third embodiments, if only one pinch roller can move over the outer circumference of the platen roller, the contact pressure of the moving pinch roller is arranged to be less than the contact pressure of the fixed pinch roller on the platen roller, and the moving pinch roller has only a guide function so that the transport amount is determined by the fixed pinch roller, resistance due to unevenness of the transport force and paper friction, etc., are reduced so that positional errors of the paper are eliminated. In the third embodiment, however, it is desirable that the pressing force of the pinch roller which is at the rear is controlled to be less than the pressing force of the pinch roller which is at the front, with respect to the transport direction of the paper.

Further, it is desirable that when the moving paper pressing means comprises a pinch roller on the paper supply side and a pinch roller on the paper discharge side as shown in the third embodiment, the pressure contact force of the pinch rollers is controlled to be small when the rollers are moving, and large when the rollers are stationary.

What is claimed is:

1. A forward-backward printing thermal printer which moves a paper back and forth a plurality of times in order to form an image, said printer comprising:

(a) a rotatable platen roller, having an outer circumference, that transports said paper forward and backward by rotating forward and backward about a platen axis, (b) a thermal head disposed facing said platen roller, said head heating an ink sheet to transfer ink onto said paper according to an input image signal, so as to transfer said image to said paper, as said paper is transported forward and backward by said platen roller, (c) a thermal head moving mechanism that moveably mounts said thermal head relative to said platen roller, said moving mechanism being constructed and arranged to move said thermal head between a first position wherein said thermal head contacts said platen roller and a second position wherein said thermal head releases said platen roller, (d) a pair of paper pressing rollers, including a first pinch roller and a second pinch roller, arranged to press said paper onto said platen roller said first pinch roller and said second pinch roller being respectively rotatable about a first pinch axis and second pinch axis, and (e) a pinch roller support member rotatably supported at said platen axis, and supporting at least said first pinch roller at said first pinch axis, said pinch roller support member rotating between a first position and second position such that when said pinch roller support member is in said first position said first pinch roller is in a starting position opposite said second pinch roller and when said pinch roller support member is in said second position said first pinch roller is in a position adjacent to said second pinch roller.

2. A forward-backward printing thermal printer as defined in claim 1, wherein said first pinch roller has a first outer diameter and said second pinch roller has a second outer diameter, said first outer diameter being smaller than said second outer diameter.

3. A forward-backward printing thermal printer as defined in claim 1, wherein said pinch roller support member presses said first pinch roller against said platen roller so that said first pinch roller exerts a first contact pressure on said platen roller and wherein a second pinch roller support member supporting at least said second pinch roller at said second pinch axis presses said second pinch roller so that said second pinch roller exerts a second contact pressure on said platen roller, and wherein said second contact pressure is a stronger pressure than said first contact pressure.

4. A forward-backward printing thermal printer as defined in claim 1, wherein said thermal head moving mechanism is constructed and arranged for moving said thermal head between said first and second positions in response to movement of said first pinch roller about said outer circumference.

5. A forward-backward printing thermal printer as defined in claim 2, wherein said pinch roller support member presses said first pinch roller against said platen roller so that said first pinch roller exerts a first contact pressure on said platen roller and wherein a second pinch roller support member supporting at least said second pinch roller at said second pinch axis presses said second pinch roller so that said second pinch roller exerts a second contact pressure on said platen roller, and wherein said second contact pressure is a stronger pressure than said first contact pressure.

6. A forward-backward printing thermal printer as defined in claim 2, wherein said thermal head moving mechanism is constructed and arranged for moving said thermal head between said first and second positions in response to movement of said first pinch roller about said outer circumference.

7. A forward-backward printing thermal printer as defined in claim 3, wherein said thermal head moving mechanism is constructed and arranged for moving said thermal head between said first and second positions in response to movement of said first pinch roller about said outer circumference.

8. A forward-backward printing thermal printer as defined in claim 5, wherein said thermal head moving mechanism is constructed and arranged for moving said thermal head between said first and second positions in response to movement of said first pinch roller about said outer circumference.

9. In a forward-backward printing thermal printer including a printing member, a moving mechanism which moves a paper, having a front edge and a back edge, back and forth on said printing member a plurality of times in order to form an image, said moving mechanism comprising:

(a) a rotatable platen roller, having an outer circumference, constructed and arranged to transport said paper forward and backward by rotating forward and backward, (b) a first pinch roller having a first grip assembly and a second pinch roller having a second grip assembly, said first pinch roller and said second pinch roller being constructed and arranged to press said paper onto said platen roller, and to thereby move said paper across said printing member from a first position wherein said front edge of said paper is engaged by said first grip assembly to a second position wherein said back edge of said paper is engaged by said second grip assembly, and (c) a pinch roller shift means for moving said first pinch roller along said outer circumference of said platen roller between a starting position wherein said first pinch roller is disposed a first circumferential distance from said second pinch roller and an ending position wherein said first pinch roller is disposed a second circumferential distance from said second pinch roller, said second circumferential distance being less than said first circumferential distance, said shift means being responsive to said paper being in said second position to move said first pinch roller from said starting to said ending position.

10. In a forward-backward printing thermal printer, a moving mechanism as defined in claim 9, wherein said printing member is a thermal head disposed facing said platen roller, said head heating an ink sheet to transfer ink onto said paper in response to an input image signal so as to transfer an image to said paper.

11. In a forward-backward printing thermal printer, a moving mechanism as defined in claim 10, comprising a thermal head moving mechanism moveably mounted relative to said platen roller and having means for moving said thermal head to contact and release said platen roller in response to movement of said first pinch roller about said circumference.

12. In a forward-backward printing thermal printer, a moving mechanism as defined in claim 11, further comprising a fan shaped gear having a central rotation axis wherein said fan shaped gear having a central rotation axis mechanically couples said thermal head moving mechanism to said pinch roller shift means so that said contact and release of said thermal head on said platen roller and said movement of said first pinch roller along said outer circumference of said platen roller are substantially synchronized.

13. In a forward-backward printing thermal printer, a moving mechanism as defined in claim 9, wherein said pinch roller shift means is comprised of a fan shaped gear driven by a drive gear.

14. A method for printing an image on a paper, comprising the steps of:

(a) guiding said paper from a first grip assembly defined by a passage between a platen roller and a first pinch roller, (b) rotating said platen roller in a first direction and said first pinch roller in a second direction so that said paper is transported to a position on an outer circumference of said platen roller, (c) rotating said platen roller and said first pinch roller so that said paper is transported to a second grip assembly defined by a passage between said platen roller and a second pinch roller, (d) shifting said first pinch roller along said outer circumference of said platen roller between a starting position opposite said second pinch roller and a position adjacent to said second pinch roller in response to said paper being in said second position, (e) rotating said platen roller and said first pinch roller and said second pinch roller so that said paper is transported by a predetermined circumferential distance, and (f) shifting said first pinch roller from said position adjacent to said second pinch roller and said starting position opposite said second pinch roller.

15. A method as defined in claim 14, further comprising retracting a thermal head mechanism from said platen roller.

16. A forward-backward printing thermal printer which moves a paper back and forth a plurality of times in order to form an image, said printer comprising:

(a) a rotatable platen roller, having an outer circumference, that transports said paper forward and backward by rotating forward and backward about a platen axis, (b) a thermal head disposed facing said platen roller, said head heating an ink sheet to transfer ink onto said paper according to an input image signal, so as to transfer said image to said paper as said paper is transported forward and backward by said platen roller, (c) a thermal head moving mechanism that moveably mounts said thermal head relative to said platen roller, said moving mechanism being constructed and arranged to move said thermal head between a first position wherein said thermal head contacts said platen roller and a second position wherein said thermal head is spaced from said platen roller, and (d) a pair of paper pressing rollers, including a first pinch roller and a second pinch roller respectively rotating about a first pinch axis and a second pinch axis, and (e) a pinch roller support member rotatably supported at said platen axis and supporting at least said first pinch roller at said first pinch axis, said pinch roller support member rotating between a starting position and an ending position such that when said pinch roller support member is in said starting position said first pinch roller is disposed a first circumferential distance from said second pinch roller and when said pinch roller support member is in said ending position said first pinch roller is disposed a second circumferential distance from said second pinch roller, said second circumferential distance being less than said first circumferential distance.

* * * * *